US005793597A

United States Patent [19]

Mizufune et al.

[11] Patent Number: 5,793,597

[45] Date of Patent: Aug. 11, 1998

[54] PUFFER TYPE GAS BREAKER

[75] Inventors: Eisaku Mizufune; Yukio Kurosawa; Katsuichi Kashimura; Osamu Koyanagi; Yoshihito Asai, all of Hitachi; Kogi Ishikawa, Mito; Ken'ichi Natsui; Masanori Tsukushi, both of Hitachi; Makoto Yano, Mito; Goro Daimon; Kenji Tsuchiya, both of Hitachi, all of Japan

[73] Assignee: Hitachi, Ltd., Tokyo, Japan

[21] Appl. No.: 587,656

[22] Filed: Jan. 17, 1996

[30] Foreign Application Priority Data

Jan. 20, 1995 [JP] Japan ..... 7-006925
Jan. 20, 1995 [JP] Japan ..... 7-006927

[51] Int. Cl.[6] ..... H01H 73/00

[52] U.S. Cl. ..... 361/116; 218/52

[58] Field of Search ..... 361/2, 14, 115, 361/116, 123; 218/13, 15, 34, 51, 52, 53, 57, 76, 81, 85, 77, 89, 90, 99, 103, 105, 106, 116, 151, 157, 108

[56] References Cited

U.S. PATENT DOCUMENTS 4,236,053 11/1980 Sasaki et al. ..... 218/57
4,259,556 3/1981 Kii ..... 218/51

FOREIGN PATENT DOCUMENTS 60-36050 8/1985 Japan ..... H01H 33/70

*Primary Examiner*—Ronald W. Leja
*Attorney, Agent, or Firm*—Fay, Sharpe, Beall, Fagan, Minnich & McKee

[57] ABSTRACT

A puffer type gas breaker is provided, in which high-temperature gas, heated by an electric arc produced immediately after a large current is broken, is quickly discharged to enhance inter-pole dielectric performance. A fixing portion for fixing an arc contact is provided in a cylindrical exhaust pipe for exhausting the high-temperature gas heated by an electric arc produced between poles immediately after a large current is broken. A rectifying member or members is provided in the fixing portion of the cylindrical exhaust pipe. An exhaust port or ports is formed in the fixing portion of the cylindrical exhaust pipe, and a shield is disposed around the outer periphery of the exhaust port or ports.

9 Claims, 7 Drawing Sheets

PUFFER TYPE GAS BREAKER

BACKGROUND OF THE INVENTION

1. Field of the Invention

The present invention relates to puffer type gas breakers, and more particularly to puffer type gas breakers adapted for large-current breaking.

2. Description of the Related Art

Recently, the electric power demand to cities is increasing, as the voltage of an electric power system is made high and the current is made large. For this reason, the size of breakers is desired to be reduced with respect to an enhancement in the high-voltage and large-current breaking performance and the demand for a reduction in the installing area at cities.

Presently, puffer type gas breakers, which use SF6 that is satisfactory as an insulating and arc-extinguishing medium, have been widely used, and as voltage is made high and current is made large, the miniaturization of the breakers is being made.

As one of the problems which must be improved for achieving a reduction in the size of the breaker, there is an improvement in the inter-pole, inter-phase, or inter-ground dielectric performance immediately after large-current breaking. If the high-temperature gas, heated by an electric arc produced between poles when current is broken, is discharged and stagnated, generally the dielectric strength of the portion where the high-temperature gas is stagnant will be reduced. With respect to these problems there is known a three-phase batch type gas breaker, in which a cylindrical exhaust pipe with an exhaust port is provided on the side of a fixed contact and in which the high-temperature gas, heated by the arc produced between poles, is introduced into the cylindrical exhaust pipe, as shown for example in Japanese Patent Publication No. 60-36050. In this gas breaker, the orientation and position of the exhaust port, etc., are controlled to enhance the inter-pole or inter-ground dielectric performance.

This kind of gas breaker will hereinafter be described with reference to the sectional structure of a conventional puffer type gas breaker shown in FIG. 12.

Main generating-line conductors 9 and 15 are electrically connected through connecting members 8 and 14 to a fixed piston 5 and a cylindrical exhaust pipe (or hollow conductor) 11, respectively. When the gas breaker is in its charge state, a main movable contact 17 and a main fixed contact 18 are electrically connected to each other and a conducting current flows.

When, on the other hand, terminal short-circuit failure occurs in the electric power system, an insulating rod 16 connected to a puffer shaft **4*a* is driven by an operating unit (not shown) in response to a breaking instruction, and a puffer action occurs between a puffer cylinder 4, integrally formed with an insulating nozzle 3 and a movable arc contact 2, and the fixed piston 5 fixed through an Insulating tube 7 to a grounded tank 1. Intake gas 13 compressed by the puffer action is injected at a high speed to a breaking arc ignited between the movable arc contact 2 and the fixed arc contact 10. When this occurs, the intake gas 13 is heated by the arc to become high-temperature gas. Part of the high-temperature gas forms a flow of gas 28 from the insulating nozzle 3 to the fixed arc contact 10, passes through the cylindrical exhaust pipe 11, and is exhausted as exhaust gas 14*b* from a plurality of exhaust ports 12*b* provided on the downstream side of the cylindrical exhaust pipe 11. On the other hand, the remaining high-temperature gas passes through the puffer shaft 4*a* and is exhausted from a plurality of exhaust ports 5*a* as exhaust gas 14*a***. In this way, a so-called double flow of the high-temperature gas is formed.

The high-temperature gas, exhausted through the insulating nozzle 3 toward the fixed arc contact 10 and introduced into the cylindrical exhaust pipe 11 at a high speed, is mixed with the ordinary-temperature gas in the cylindrical exhaust pipe 11, while passing through the cylindrical exhaust pipe 11, and at the same time is brought into contact with the inner surface of the cylindrical exhaust pipe 11. Therefore, the high-temperature gas is cooled by the high heat conductivity of the metal conductor constituting the cylindrical exhaust pipe 11. Thus, the exhaust gas **14*b*, exhausted through the downstream exhaust ports 11*a* of the cylindrical exhaust pipe 11, is mixed with the ordinary-temperature gas existing in the outer periphery of the cylindrical exhaust pipe 11**, and a sufficient gas density is assured. As a consequence, the dielectric performance of the high-temperature gas is recovered.

Therefore, in the terminal short-circuit failure which is an obligation of breaking, when a voltage is recovered between the poles of the breaker, the dielectric breakdown between the high-voltage section and the grounded tank 1 is suppressed and the breaking performance of the terminal short-circuit failure is enhanced.

However, in the conventional breaker, the cooling efficiency is low because the high-temperature gas, exhausted from the insulating nozzle 3 and heated by the arc, is simply passed through the cylindrical exhaust pipe 11. Therefore, from the fact that the dielectric strength of the high-temperature gas is remarkably reduced as compared with ordinary-temperature gas, the dielectric strength between the high-voltage section and the grounded tank 1 is locally reduced and dielectric breakdown occurs, because of the exhaust gas **14*b* exhausted from the cylindrical exhaust pipe 11**. For this reason, there are some cases where in the terminal short-circuit failure the breaking becomes impossible in a terminal short-circuit failure.

To cope with this problem, in the conventional breaker the distance between the high-voltage section and the grounded tank 1 is made longer from the point of view that the dielectric strength is assured. Also, in order to enhance the cooling efficiency of the cylindrical exhaust pipe 11, it is necessary to make the distance that the high-temperature gas travels within the cylindrical exhaust pipe 11 longer. In either method, there is the problem that the size of the gas breaker is increased.

Also, in order to further reduce the size of the breaking section itself, it is required that the exhaust of the high-temperature gas from between the poles to the cylindrical exhaust pipe on the fixed arc contact side be more efficiently performed. It becomes a problem to quickly cool the gas between the poles immediately after a large current is broken and to enhance the dielectric performance between the poles. In the conventional breaker, the area of the gas flow passage of the inlet portion of the cylindrical exhaust pipe is contracted because the fixed arc contact is fixed to the inlet portion of the cylindrical exhaust pipe. As a consequence, the high-temperature gas exhausted to the inlet portion cannot smoothly pass through the cylindrical exhaust pipe, the high-temperature gas impinges against the fixing portion, the gas flows backward in the direction toward the poles, and there occurs the problem that the cooling efficiency of the high-temperature gas is unfavorable.

SUMMARY OF THE INVENTION

A first object of the present invention is to provide a puffer type gas breaker, in which the exhaust of high-temperature gas from between poles to a cylindrical exhaust pipe on a fixed arc contact side is efficiently performed and the dielectric performance between the poles is enhanced, in order to make the voltage of the breaking section high, the current large, and the size small.

A second object of the present invention is to provide a puffer type gas breaker, in which the cooling efficiency of the high-temperature gas in a cylindrical exhaust pipe, exhausted from an insulating nozzle to a fixed arc contact side, is enhanced without increasing the size of the breaker and in which the breaking performance of terminal short-circuit failure is enhanced.

To achieve the aforementioned first object, in the puffer type gas breaker of the present invention a fixing portion for fixing an fixed arc contact is provided in a cylindrical exhaust pipe. Also, a rectifying member is provided in the fixing portion of the cylindrical exhaust pipe. Furthermore, an exhaust port is provided in the cylindrical exhaust pipe at the fixing portion and a shield is provided around an outer peripheral portion of the exhaust port.

Because the fixing portion for fixing the fixed arc contact is provided in the cylindrical exhaust pipe, the arc extinguishing performance between the poles is not influenced even if the high-temperature gas impinges against the fixing portion of the exhaust pipe and the flow of the high-temperature gas in the exhaust pipe is disturbed. Also, since most of the high-temperature gas passes through the cylindrical exhaust pipe, the exhaust efficiency of the high-temperature gas from between the poles is improved and the dielectric performance between the poles is enhanced. In addition, since the rectifying member is provided in the fixing portion, the efficiency of the gas flow passage in the cylindrical exhaust pipe is increased. Furthermore, since the exhaust port is provided in the fixing portion of the fixed arc contact of the cylindrical exhaust pipe, the high-temperature gas partly stagnating in the fixing portion is discharged outside the cylindrical exhaust pipe, so that equivalently the flow passage loss in the cylindrical exhaust pipe can be reduced. Moreover, since a shield is disposed around the outer peripheral of the exhaust port, the diffusion and cooling of the gas once cooled in the cylindrical exhaust pipe are further accelerated and therefore a reduction in the dielectric performance of a portion other than the breaking section, such as a reduction in the inter-pole or inter-ground dielectric performance, can be prevented.

To achieve the aforementioned second object, the puffer type gas breaker of the present invention is characterized in that an fixed arc contact, disposed in a coaxial relationship with an insulating nozzle, is fixed, and that, in addition to a plurality of exhaust ports provided in the downstream side surface of a cylindrical exhaust pipe electrically connected to a main generating-line conductor, a plurality of intake ports are provided upstream side surface of the hollow conductor. The ordinary-temperature gas existing in the outside of the cylindrical exhaust pipe is introduced through the ports into the cylindrical exhaust pipe so that the high-temperature gas is efficiently cooled.

Also, the invention is characterized in that a plurality of flow passages are formed in the cylindrical exhaust pipe by partitioning the cylindrical exhaust pipe with metal plates, and in that the high-temperature gas, introduced into the cylindrical exhaust pipe, is distributed to the plurality of flow passages to be passed therethrough.

In addition, the invention is characterized in that a spiral flow passage is formed in the cylindrical exhaust pipe by fixing a spiral metal plate to a fixed rod disposed in a coaxial relationship with the fixed arc contact.

The high-temperature gas, exhausted from the insulating nozzle and introduced into the cylindrical exhaust pipe, passes through the hollow conductor at a high speed, and consequently, the pressure in the cylindrical exhaust pipe becomes lower than the pressure in the outside of the cylindrical exhaust pipe. As a result, the ordinary-temperature gas outside of the cylindrical exhaust pipe is introduced into the cylindrical exhaust pipe through the intake ports disposed in the upstream side of the cylindrical exhaust pipe. For this reason, the high-temperature gas introduced into the cylindrical exhaust pipe is efficiently cooled and is exhausted from the downstream exhaust ports of the cylindrical exhaust pipe to the outside. Therefore, the exhaust gas is sufficiently reduced in temperature and is mixed with the ordinary-temperature gas existing between the outer peripheral portion of the cylindrical exhaust pipe and the grounded tank, and the dielectric strength of the exhaust gas is recovered.

When the high-temperature gas heated by the electric arc is distributed and passed through a plurality of flow passages partitioned by metal plates having a better heat conductivity, which are provided in the cylindrical exhaust pipe, the high-temperature gas passes while contacting with the metal plates. Therefore, the heat conducting area of the metal plates is increased as compared with the conventional breaker, and a further efficient cooling is achievable.

When the high-temperature gas passes through the spiral passage formed by the metal plate disposed in the cylindrical exhaust pipe, the high-temperature gas passes through the cylindrical exhaust pipe, while performing a spiral motion along the flow passage. As a result, because the high-temperature gas efficiently contacts with the metal plate, while being agitated, and passes through the cylindrical exhaust pipe, the flow passage length of the cylindrical exhaust pipe becomes longer and therefore the heat conducting area of the metal plate is increased as compared with the conventional breaker. Accordingly, the cooling efficiency is enhanced.

Thus, in accordance with the present invention, the breaking performance of the gas breaker with respect to the terminal short-circuit failure is enhanced, while preventing an increase in the length of the cylindrical exhaust pipe which is caused in order to enhance a cooling ability and preventing an increase in the size of the gas breaker which is caused in order to assure an insulating distance.

BRIEF DESCRIPTION OF THE DRAWINGS

The above and other objects and advantages will become apparent from the following detailed description when read in conjunction with the accompanying drawings wherein.

DETAILED DESCRIPTION OF THE PREFERRED EMBODIMENTS

Embodiments of the present invention will hereinafter be described with FIGS. 1 to 5.

Figure 1:
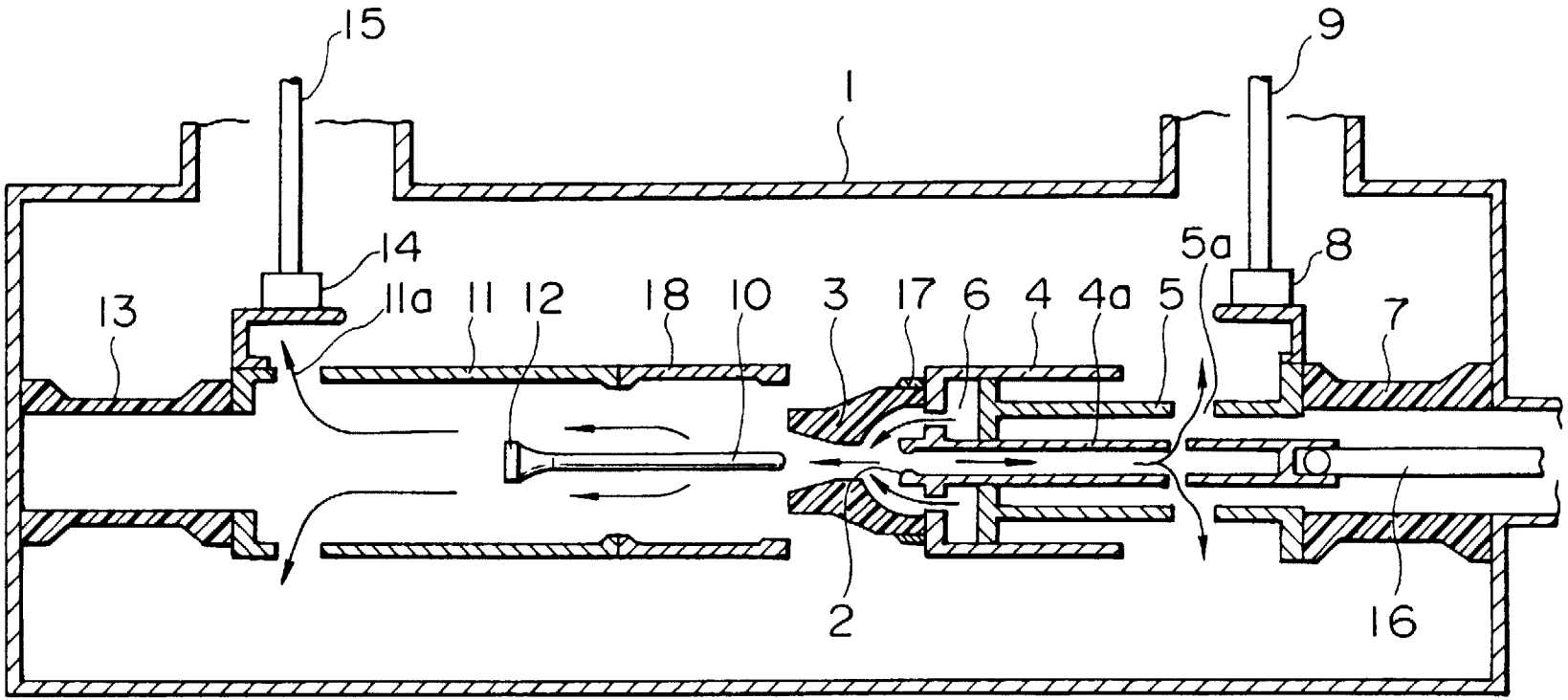
FIG. 1 is a longitudinal sectional view of a breaking section of a puffer type gas breaker according to an embodiment of the present invention.
Figure 2:
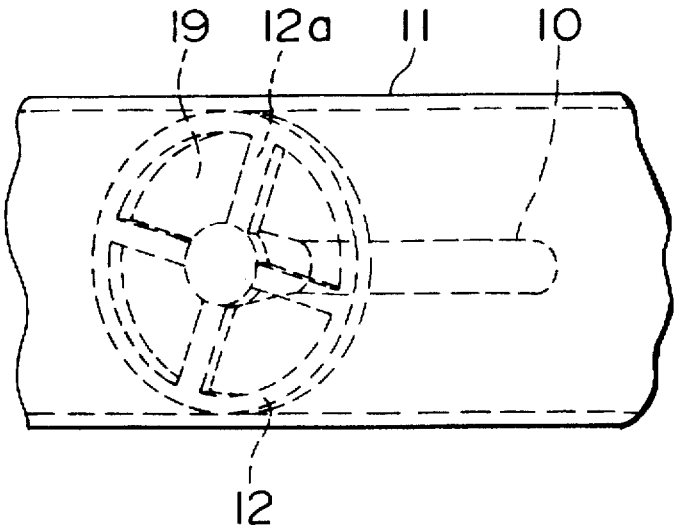
FIG. 2 is an enlarged perspective view of a fixing portion of the gas breaker shown in FIG. 1.

FIG. 1 shows a sectional view of a breaking section of a puffer type gas breaker according to an embodiment of the present invention. In FIG. 1 there is shown an intermediate state of a breaking operation, and an arc-extinguishing gas such as $SF_6$ is filled in a container or grounded tank 1. A movable arc contact 2 and an insulating nozzle 3 are integral with or fixed to a puffer cylinder 4. The puffer cylinder 4 and a fixed piston 5 as a whole constitute a puffer chamber 6 which is a pressure generating section. The movable arc contact 2 is electrically connected to a main generating-line conductor 9 through the fixed piston 5 and a connecting member 8. The fixed piston 5 is fixed through an insulating tube 7 to the container 1. A fixed arc contact 10 is fixed to a fixing portion 12 provided in a cylindrical exhaust pipe 11, which in turn is connected through an insulating tube 13 to the container 1. The fixed arc contact 10 is electrically connected through the cylindrical exhaust pipe 11 and a connecting member 14 to another generating-line conductor 15. The puffer cylinder 4 is driven by an operating unit (not shown) from outside of the container 1 through an insulating rod 16 mechanically connected to a puffer shaft 4*a*. Reference numerals 17 and 18 denote conducting contacts, and reference numerals 5*a* and 11*a* denote exhaust ports. In FIG. 1, a flow of gas which occurs at the time of a breaking operation is indicated by an arrow. In FIG. 2 there is shown a partial view of the vicinity of the fixed arc contact 10 and the fixing portion 12. Reference numerals 12*a* and 19 denote a fixed rib and a vent hole, respectively.

If the puffer cylinder 4 is driven at the time of the breaking operation by the operating unit (not shown), then the gas in the puffer chamber 6 will be compressed. With this compression operation, an electric arc is ignited between the movable arc contact 2 and the fixed arc contact 10 opposed to the contact 2. The arc-extinguishing gas compressed in the puffer chamber 6 is injected through the insulating nozzle 3 against the arc at a high speed, and the arc is extinguished. When this occurs, the arc-extinguishing gas is heated by the arc and becomes high-temperature gas, and the high-temperature gas is exhausted in a direction toward the fixed arc contact 10 and also is exhausted through the puffer shaft 4*a* provided on the side of the movable arc contact 2. The high-temperature gas, jetted against the arc at a high speed and exhausted toward the fixed arc contact 10, is exhausted into the metallic cylindrical exhaust pipe 11 having a circular or rectangular cross section at a high speed, is diffused and cooled while passing through the cylindrical exhaust pipe 11, and then is exhausted from the exhaust port 11*a*.

Figure 12:
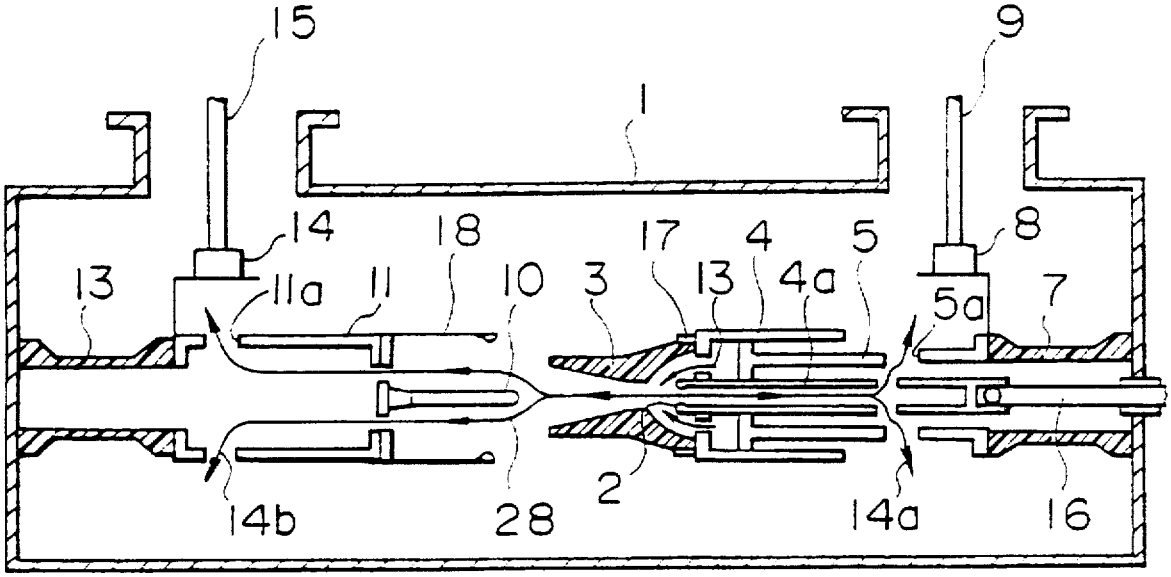
FIG. 12 PRIOR ART
FIG. 12 is a longitudinal sectional view of a conventional puffer type gas breaker.

Because in the conventional breaker shown in FIG. 12 the fixed arc contact 10 is fixed at the inlet portion of the cylindrical exhaust pipe 11, the gas flow passage area of the inlet portion of the cylindrical exhaust 11 is contracted and therefore the high-temperature gas is stagnated at the inlet portion of the cylindrical exhaust pipe 11. That is, the exhaust of the high-temperature gas to the cylindrical exhaust pipe 11 has been limited, but if the fixed arc contact 10, as in the present invention, is constructed so as to be fixed to the fixing portion 12 provided in the cylindrical exhaust pipe 11 as shown in FIG. 1, most of the high-temperature gas between the poles will be exhausted into the cylindrical exhaust pipe 11. Thus, the exhaust efficiency of the high-temperature gas from between the poles is improved, so there is the advantage that inter-pole dielectric performance can be enhanced.

Figure 3:
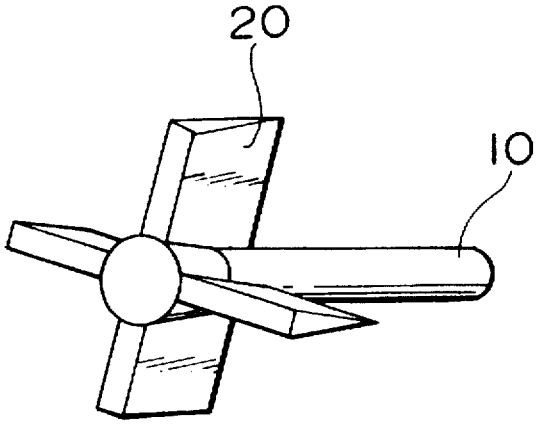
FIG. 3 is an enlarged perspective view of a fixing portion of a puffer type gas breaker according to a second embodiment of the present invention.

FIG. 3 is a partial view showing a second embodiment of the present invention. This embodiment is substantially identical with the first embodiment of FIGS. 1 and 2, except that a plurality of tapered rectifying members 20 are provided in the fixing rib 12*a* to which the fixed arc contact 10 is fixed. As shown in FIG. 2, in the fixing portion 12 of the first embodiment, the ribs 12*a* for fixing the fixed arc contact 10 are required from the structural point of view, but the gas flow passage area is contracted. By providing the rectifying members 20, the flow passage loss of the high-temperature gas in the cylindrical exhaust pipe 11 can be reduced. Consequently, there is the advantage that the exhaust efficiency of the gas into the cylindrical exhaust pipe 11 can be increased.

Figure 4:
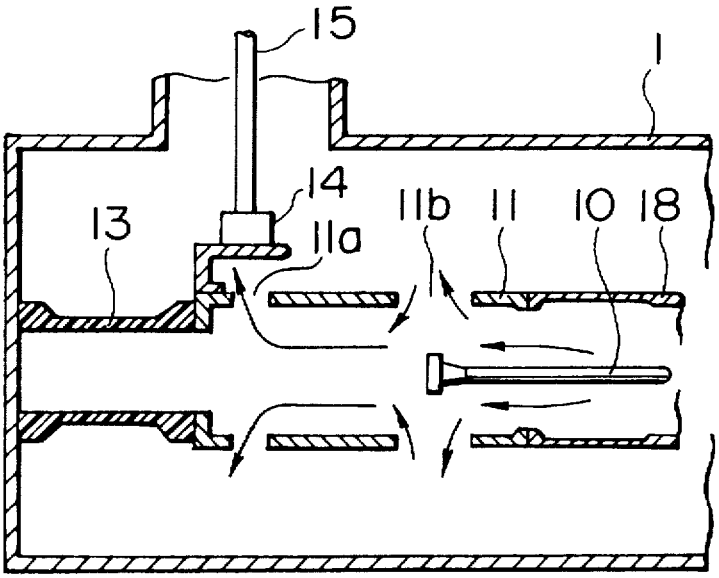
FIG. 4 is a fragmentary sectional view of a puffer type gas breaker according to a third embodiment of the present invention.

FIG. 4 is a partial view showing a third embodiment of the present invention. This embodiment is substantially identical with the first embodiment of FIGS. 1 and 2 or the second embodiment of FIG. 3, except that an intake/exhaust port 11*b* is provided in the cylindrical exhaust pipe 11 about the fixing portion 12. By discharging the high-temperature gas, stagnated due to the flow passage loss of the fixing portion 12, from the intake/exhaust port 11*b* to the outside, equivalently there is the advantage that the flow passage loss in the cylindrical exhaust pipe 11 can be reduced. As the high-temperature gas once cooled is discharged from the intake/exhaust port 11*b*, the pressure in the cylindrical exhaust pipe 11 is reduced by the flow of the gas that passed through the fixing portion 12. This reduction in the pressure causes gas to flow from the intake/exhaust port 11*b* into the cylindrical exhaust pipe 11. Therefore, there is the advantage that the cooling of the gas in the cylindrical exhaust pipe 11 is accelerated by the flow of the gas from the intake/exhaust port 11*b*.

Figure 5:
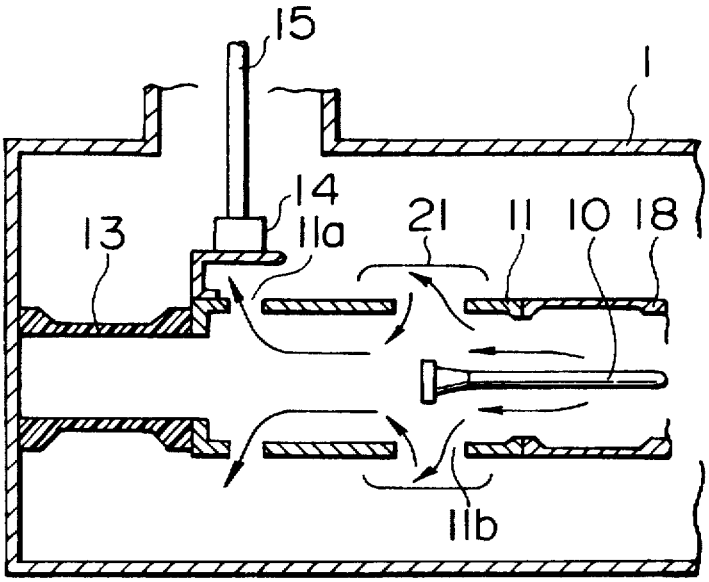
FIG. 5 is a fragmentary sectional view of a puffer type gas breaker according to a fourth embodiment of the present invention.

FIG. 5 is a partial view showing a fourth embodiment of the present invention. This embodiment is substantially identical with the third embodiment of FIG. 4, except that a shield 21 is provided around the outer periphery of the exhaust port 11*b*. There is the advantage that a reduction in the dielectric performance between the breaking section and the container 1, which is caused by the gas once cooled in the cylindrical exhaust pipe 11, can be almost prevented. Also, in a three-phase batch tank type breaker, according to this embodiment of the present invention there is the advantage that the inter-phase dielectric performance can be enhanced as compared with the conventional breaker of FIG. 12.

A fifth embodiment of the present invention will hereinafter be described while referring to FIG. 6. The same reference numerals will be applied to the same parts as the conventional breaker of FIG. 12 and therefore a description of the same parts will not be given.

Figure 6:
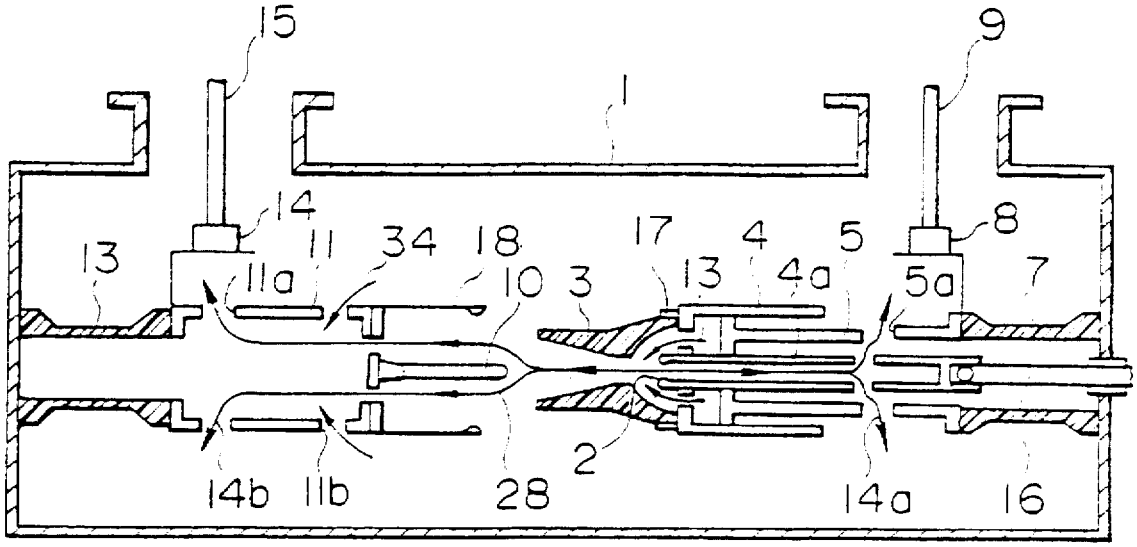
FIG. 6 is a longitudinal sectional view of a puffer type gas breaker according to a fifth embodiment of the present invention.

In FIG. 6 there is shown a fifth embodiment of a puffer type gas breaker according to the present invention.

In the sectional structure of the puffer type gas breaker of FIG. 6, a breaking section is formed by a puffer cylinder 4 integral with a movable arc contact 2 and an insulating nozzle 3, a fixed piston 5, and a fixed arc contact 10. The puffer cylinder 4 is driven by an operating unit (not shown) through an insulating rod 16 mechanically connected to a puffer shaft 4*a*, to provide a puffer action. The fixed piston 5 is fixed through an insulating tube 7 to a grounded tank 1 and is electrically connected through a connecting member 8 to a main generating-line conductor 9.

An electric arc is ignited between the movable arc contact 2 and the fixed arc contact 10 provided in an opposed relationship with the contact 2. Intake gas 13, composed of an insulating arc-extinguishing gas compressed by the puffer action, is jetted against the arc at a high speed. The arc-extinguishing gas is heated by the thermal energy of the arc to become high-temperature gas. The high-temperature gas is exhausted in the downstream direction of the insulating nozzle 3 and also in the upstream direction of the insulating nozzle 3 through a puffer shaft 4*a*. In this way, a so-called double flow of the high-temperature gas is formed.

The fixed arc contact 10 is fixed to a cylindrical exhaust pipe 11, which in turn is electrically connected through a connecting member 14 to a main generating-line conductor 15. The cylindrical exhaust pipe 11 is mechanically connected through an insulating tube 13 to a grounded tank 1.

The high-temperature gas, exhausted through the insulating nozzle 3 toward the fixed arc contact 10 at a high speed, is introduced into the metallic cylindrical exhaust pipe 11 having a circular or rectangular cross section at a high speed. The introduced high-temperature gas passes through the cylindrical exhaust pipe 11 at a high speed, and the pressure in the cylindrical exhaust pipe 11 becomes lower than the pressure outside of the cylindrical exhaust pipe 11. As a result, the ordinary-temperature gas in the outside of the cylindrical exhaust pipe 11 is rapidly introduced into the cylindrical exhaust pipe 11 as an intake gas 34 through a plurality of intake/exhaust ports 11*b* disposed in the upstream side of the cylindrical exhaust pipe 11. Thus, the high-temperature gas is mixed and agitated within the cylindrical exhaust pipe 11 with the ordinary-temperature gas introduced from the intake/exhaust ports 116, and is efficiently cooled. As a consequence, when the cooled gas passes through the cylindrical exhaust pipe 11 to be exhausted from the exhaust port 11*a*, the exhaust gas 14*b* is mixed with the ordinary-temperature gas existing in the outer peripheral portion of the cylindrical exhaust pipe 11. Therefore, the dielectric strength of the exhaust gas 14*b* is recovered, and the dielectric breakdown between the high-voltage section and the grounded tank 1 is suppressed.

Figure 7:
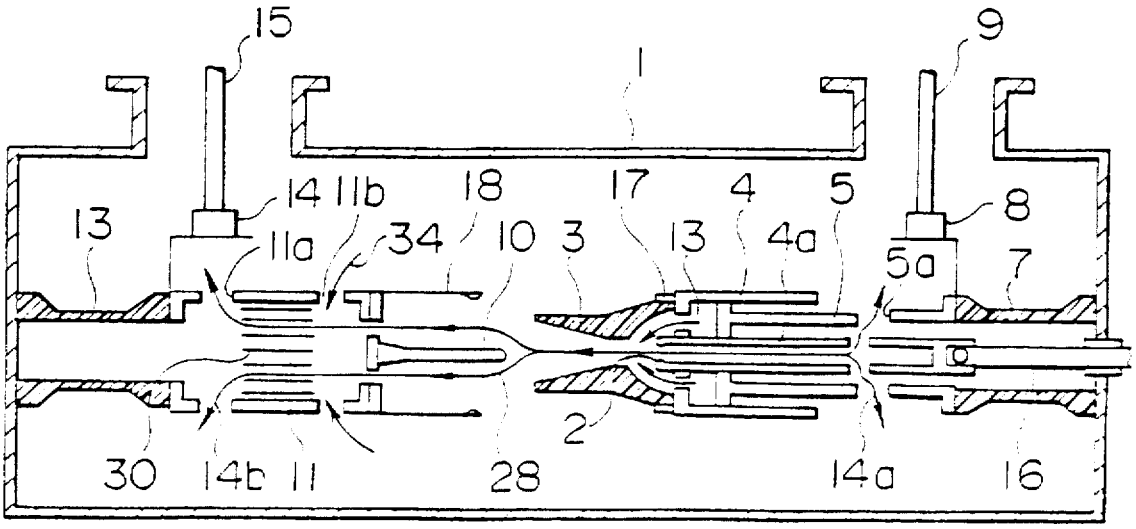
FIG. 7 is a longitudinal sectional view of a puffer type gas breaker according to a sixth embodiment of the present invention.

FIG. 7 shows a sectional view of a breaking section of a puffer type gas breaker, which is a seventh embodiment of the present invention. Further, FIG. 8 shows an enlarged perspective view of a cylindrical exhaust pipe 11 shown in FIG. 7.

Figure 8:
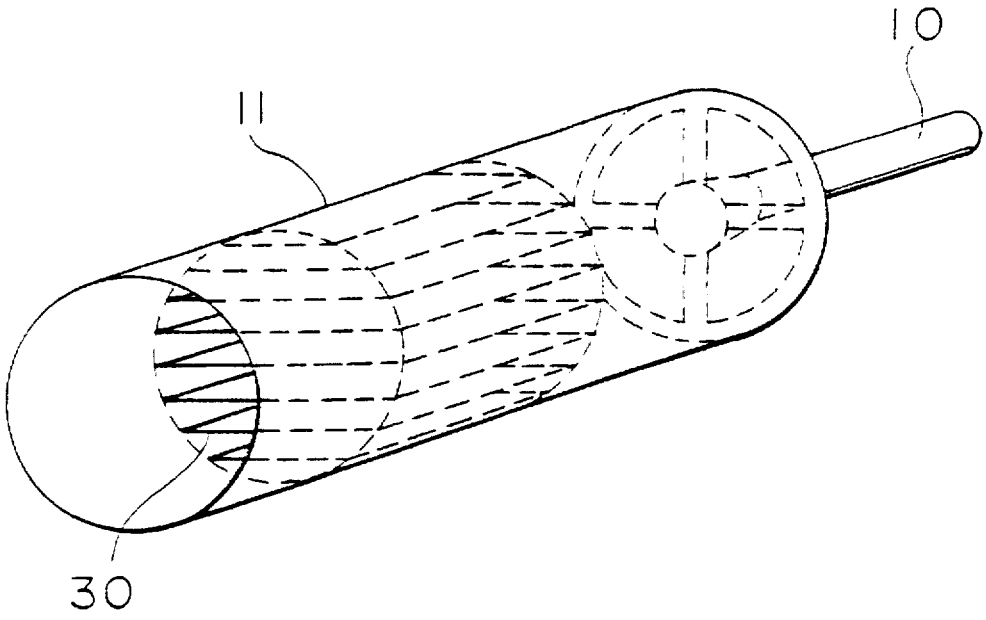
FIG. 8 is an enlarged perspective view of a cylindrical exhaust pipe of a puffer type gas breaker according to a seventh embodiment of the present invention.

In FIG. 8 a plurality of flow passages partitioned by metal plates 30 are formed in the cylindrical exhaust pipe 11, and the metal plates 30 serve as cooling plates having a high heat conductivity.

The high-temperature gas, introduced into the hollow conductor 25, passes through a plurality of flow passages, as shown in FIG. 7, and consequently, the heat conducting area of the metal plates 30 is increased compared with the conventional breaker of FIG. 12. For this reason, the thermal energy that the high-temperature gas has is effectively removed through the metal plates 30.

Figure 9:
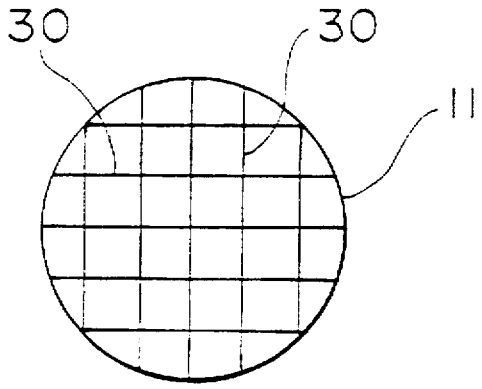
FIG. 9 is a cross sectional view of a cylindrical exhaust pipe of a puffer type gas breaker according to an eighth embodiment of the present invention.

FIG. 9 shows a cross sectional view of a cylindrical exhaust pipe of a buffer type gas breaker according to an eighth embodiment of the present invention. As shown in FIG. 9, this embodiment is characterized in that metal plates 30 in the form of a lattice are disposed to subdivide a flow passage. As a result, the heat conducting area of the metal plates 30 for conducting the heat of the high-temperature gas is further increased and the cooling effect of the metal plates is enhanced.

Figure 10:
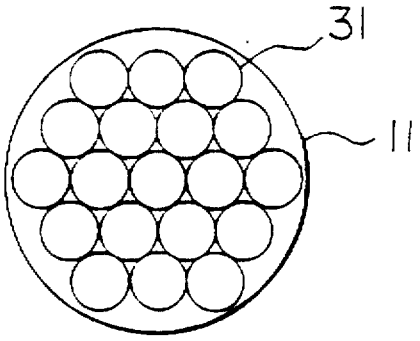
FIG. 10 is a cross sectional view of another embodiment of a cylindrical exhaust pipe.

FIG. 10 shows a cross sectional view of another embodiment of a cylindrical exhaust pipe according to the present invention. This embodiment is characterized in that a plurality of metal pipes 31 are bundled to form a plurality of flow passages. Likewise, the heat conducting area of the metal pipes 31 is increased and an efficient cooling effect is obtained, because high-temperature gas is distributed into a plurality of metal pipes and flows through the metal pipes.

Figure 11:
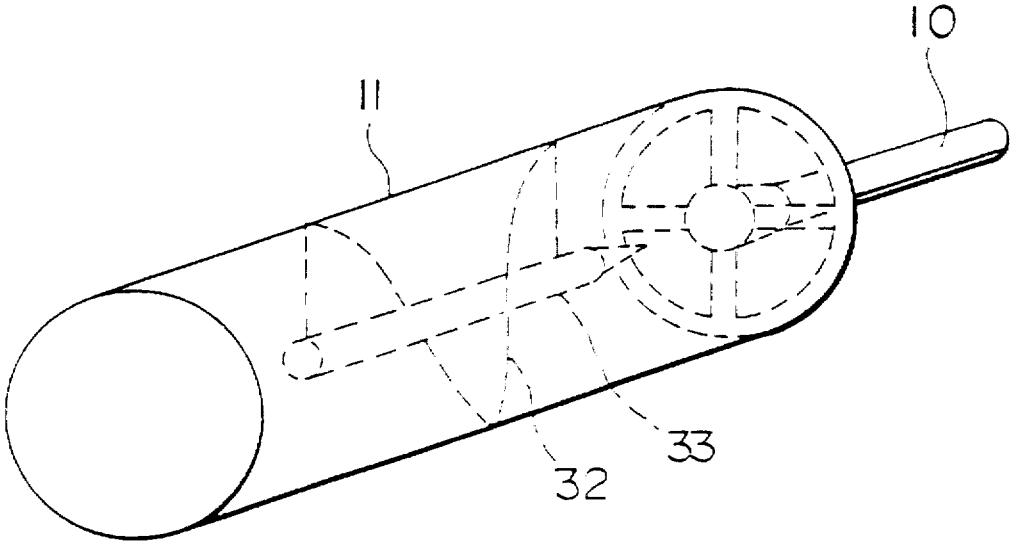
FIG. 11 is an enlarged perspective view of still another embodiment of a cylindrical exhaust pipe.

FIG. 11 shows a perspective view of a breaking section of a puffer type gas breaker according to a ninth embodiment of the present invention. This embodiment is characterized in that a metal support rod 33 is provided on a center axis of a cylindrical exhaust pipe 11, and a spiral metal plate 32 is fixed to the support rod 33 to form a spiral flow passage. The high-temperature gas, introduced into the cylindrical exhaust pipe 11 at a high speed, advances while being mixed and agitated with the ordinary-temperature gas existing in the cylindrical exhaust pipe 11. Therefore, the length of the flow passage of the in the cylindrical exhaust pipe 11 becomes substantially longer and the cooling efficiency of the cylindrical exhaust pipe 11 remarkably increases.

Thus, in accordance with the present invention, as compared with the conventional breaker, the high temperature exhaust gas 14*b* of exhausted from the insulating nozzle 3 to the fixed arc contact 10 side is sufficiently reduced in temperature by an enhancement in the cooling efficiency of the cylindrical exhaust pipe 11, and the dielectric strength of the gas is recovered. Accordingly, the dielectric strength between the high-voltage section and the grounded tank 1 is assured and the breaking performance in the terminal short-circuit failure is achievable, without increasing the size of the gas breaker.

In accordance with the present invention, the high-temperature gas between the poles is efficiently exhausted into the cylindrical exhaust pipe as compared with the conventional gas breaker. Accordingly, it becomes possible to provide a puffer type gas breaker in which the inter-pole dielectric performance is particularly enhanced immediately after large-current breaking.

In addition, because the cooling performance in the cylindrical exhaust pipe with respect to the high-temperature gas is considerably enhanced, a sufficient gas density is assured between the high-voltage section and the grounded tank.

As a result, there is no increase in the size of the gas breaker, there is no static dielectric break-down between the high-voltage section and the grounded tank, which results from a transient recovery voltage, and an enhancement in the dielectric performance of the terminal short-circuit failure is achievable.

While the invention has been described with reference to specific embodiments thereof, it will be appreciated by those skilled in the art that numerous variations, modifications, and embodiments are possible, and accordingly, all such variations, modifications, and embodiments are to be regarded as being within the scope of the invention.

What is claimed is:

1. In a puffer type gas breaker including a movable arc contact, a fixed arc contact provided in an opposed relationship with said movable contact, a puffer cylinder integrally formed with said movable arc contact and an insulating nozzle, a cylindrical exhaust pipe which is opposed to said insulating nozzle and to which said fixed arc contact is fixed, and an operating unit which drives an insulating rod mechanically connected to said puffer cylinder to provide a puffer action to compress an insulating gas in a puffer chamber to jet the compressed insulating gas against an electric arc ignited between said movable arc contact and said fixed arc contact at a time of current breaking, the improvement comprising:

an exhaust port in each of an upstream side surface and a downstream side surface of said cylindrical exhaust pipe, said upstream exhaust port being located in said cylindrical exhaust pipe at a location where said fixed arc contact is fixed to a fixing portion in said cylindrical exhaust pipe for fixing said fixed arc contact to the cylindrical exhaust pipe, said upstream exhaust port exhausting said compressed insulating gas out of the cylindrical exhaust pipe and receiving cooler insulating gas into the cylindrical exhaust pipe.

2. A puffer type gas breaker as set forth in claim 1, wherein said fixing portion includes a gas rectifier, said gas rectifier being arranged to inhibit upstream flow of said arc-extinguishing gas.

3. A puffer type gas breaker as set forth in claim 2, further comprising a second exhaust port in said cylindrical exhaust pipe at said fixing portion, and a shield around said cylindrical exhaust pipe in the vicinity of the second exhaust port.

4. A puffer type gas breaker as set forth in claim 1, further comprising a shield around said cylindrical exhaust pipe in the vicinity of the upstream exhaust port.

5. A puffer type gas breaker as set forth in claim 1, wherein said cylindrical exhaust pine has a circular cross section.

6. A puffer type gas breaker as set forth in claim 1, further comprising a plurality of flow passages in said cylindrical exhaust pipe, wherein said plurality of flow passages are defined by a plurality of metal circular pipes in said cylindrical exhaust pipe.

7. A puffer type gas breaker as set forth in claim 1, further comprising a spiral flow passage in said cylindrical exhaust pipe, wherein said spiral flow passage is defined by a spiral metal plate.

8. A puffer type gas breaker as set forth in claim 1, further comprising a heat-conductive lattice in said cylindrical exhaust pipe and fixed thereto.

9. In a puffer type gas breaker including a movable arc contact, a fixed arc contact coaxially provided in an opposed relationship with said movable arc contact, a puffer cylinder integrally formed with said movable arc contact and an insulating nozzle, a cylindrical exhaust pipe which is opposed to said insulating nozzle and to which said fixed arc contact is fixed, and an operating unit which drives an insulating rod mechanically connected to said puffer cylinder to provide a puffer action to compress an insulating gas in a puffer chamber to jet the compressed insulating gas against an electric arc ignited between said movable arc contact and said fixed arc contact at a time of current breaking, the improvement comprising:

a plurality of flow passages in said cylindrical exhaust pipe;

wherein said plurality of flow passages are defined by a plurality of layered metal plates in said cylindrical exhaust pipe.

* * * * *